United States Patent [19]

Lührsen et al.

[11] Patent Number: 4,949,886

[45] **Date of Patent: * Aug. 21, 1990**

[54] HORIZONTAL OR VERTICAL ROTARY VALVE FOR A METALLURGICAL VESSEL

[75] Inventors: Ernst Lührsen, Bad Schwalbach; Ullrich Hintzen, Taunusstein-Watzhahn; Raimund Brückner, Engenhahn, all of Fed. Rep. of Germany

[73] Assignee: Didier-Werke AG, Wiesbaden, Fed. Rep. of Germany

[ * ] Notice: The portion of the term of this patent subsequent to Apr. 3, 2007 has been disclaimed.

[21] Appl. No.: 248,550

[22] Filed: Sep. 19, 1988

Related U.S. Application Data

[63] Continuation-in-part of Ser. No. 227,880, Aug. 3, 1988, Pat. No. 4,913,324.

[30] Foreign Application Priority Data

Sep. 19, 1987 [DE] Fed. Rep. of Germany ..... 3731600

[51] Int. Cl.[5] ..... B22D 41/14

[52] U.S. Cl. ..... 222/599; 222/598; 266/236

[58] Field of Search ..... 266/236; 222/598, 599, 222/600, 597, 591

[56] References Cited

U.S. PATENT DOCUMENTS 3,651,998 3/1972 Rocher ..... 222/598

FOREIGN PATENT DOCUMENTS 3306670 9/1984 Fed. Rep. of Germany .
3540202 11/1986 Fed. Rep. of Germany .
0183241 7/1922 United Kingdom .
88/05355 7/1988 World Int. Prop. O. ..... 222/598

*Primary Examiner*—S. Kastler
*Attorney, Agent, or Firm*—Wenderoth, Lind & Ponack

[57] ABSTRACT

A rotary valve for controlling the discharge of molten metal from a metallurgical vessel includes a refractory rotor having a cylindrical outer peripheral surface and fitted within a recess defined by a cylindrical inner surface in a refractory stator and complementary to the outer surface. The rotor may be rotated about either a horizontal or a vertical axis relative to the stator and may be axially moved within the recess therein. The rotary valve may be mounted on the exterior of a bottom wall of a metallurgical vessel or alternatively may be mounted within a refractory lining of the metallurgical vessel, particularly in a transition area between a side wall and a bottom wall of the metallurgical vessel. Further alternatively, the rotary valve may be mounted within the refractory lining of the bottom wall of the metallurgical vessel, with the rotor extending through the bottom wall and being actuated for movement from below the bottom wall.

32 Claims, 2 Drawing Sheets

HORIZONTAL OR VERTICAL ROTARY VALVE FOR A METALLURGICAL VESSEL

Reference to Related Application

The present application is a continuation-in-part of application Ser. No. 227,880, filed Aug. 3, 1988, now U.S. Pat. No. 4,913,32 and entitled "Rotary Valve for a Metallurgical Vessel and Rotor and Stator Therefor" by the same inventors.

BACKGROUND OF THE INVENTION

The present invention relates to a rotary valve for controlling the discharge of molten metal from a metallurgical vessel, the rotary valve including a refractory rotor to be rotatable about an axis within a refractory stator having a discharge channel, wherein the rotor has a flow channel to be moved into and out of alignment with the discharge channel upon rotation of the rotor about the axis and/or upon axial movement of the rotor along the axis. The present invention also relates to a refractory rotor and to a refractory stator employable in such rotary valve.

A rotary valve disclosed in DE-PS 33 06 670 achieves molten metal discharge horizontally and has a rotor designed as a relatively long valve member having therethrough a bore with a discharge port and projecting sideways horizontally out of a vessel bottom. Thus, short pouring paths cannot be achieved, and there is a high risk of freezing of the metal. Also, since the valve member is made of a refractory material and has therethrough an axial bore, it is not possible to transfer to the rotors sufficient torque, when the rotor is tightly seated against the stator, to rotate the rotor, when the rotor and stator are subjected to thermal expansion. Further, the rotor has relatively thin walls as a result of which the rotor is susceptible to wearing out rapidly.

In a rotary valve disclosed in GB-PS 183 241, the stator and rotor are arranged substantially below the vessel bottom, so that there is a significant risk of freezing of the molten metal. Furthermore, the rotor has an axis of rotation that is perpendicular to a vertical discharge channel of the stator and flow channel extending perpendicular to such axis of rotation.

DE-PS 35 40 202 discloses a valve for controlling the discharge of molten metal to a continuous casting installation wherein the cross-section of a discharge opening can be regulated. The valve includes two concentrically and vertically arranged tubes with holes for passage therethrough of the molten metal. By adjusting at least one of the tubes, the openings of the tubes may be brought into or out of alignment. The relative motion of the tubes may be rotary and/or axial. The inner tube may be formed as a casting tube. Movement is achieved by an operation from above the melt, with the result that the movement control elements can interfere with necessary transport devices. Further, the operating elements thus are arranged in an area of very high temperature and are exposed to the molten metal itself.

SUMMARY OF THE INVENTION

Accordingly, it is an object of the present invention to provide a rotary valve for controlling the discharge of molten metal in a substantially downward direction from a metallurgical vessel whereby it is possible to overcome the above and other prior art disadvantages.

It is a more particular object of the present invention to provide such a rotary valve of simplified construction and capable of simplified repair and replacement, while at the same time providing reliable operation and particularly a sufficiently tight seal without the application of pressure.

It is a still further object of the present invention to provide a refractory rotor for such refractory valve.

It is a yet further object of the present invention to provide a refractory stator for such rotary valve.

These objects are achieved in accordance with one aspect of the present invention by the provision of a rotary valve mountable on the exterior of the bottom of a metallurgical vessel and including a rotor having a cylindrical outer peripheral surface arranged symmetrically about a substantially horizontal axis, the rotor having therethrough a flow channel having inlet and outlet ports, at least one of the inlet and outlet ports opening onto the outer surface. A refractory stator has therein a recess defined by a cylindrical inner surface complementary to the outer surface of the rotor, the stator having therethrough a discharge channel, and the stator being mountable on the exterior of the bottom of the metallurgical vessel. The rotor is at least partially fitted within the recess in the stator with the outer and inner surfaces of the rotor and stator, respectively, being complementarily positioned symmetrically about the horizontal axis, such that rotation of the rotor about the axis relative to the stator and/or axial movement of the rotor within the recess relative to the stator selectively bring the flow channel of the rotor into and out of alignment with the discharge channel of the stator.

In accordance with a further aspect of the present invention, the rotary valve is mountable within a refractory lining of a side wall of a metallurgical vessel and includes a refractory rotor rotatable about a substantially horizontal axis. The rotor has a cylindrical outer peripheral surface arranged symmetrically about the axis, and the rotor has therethrough a flow channel having inlet and outlet ports, the outlet port opening onto the outer surface. A one-piece refractory stator has therein a recess defined by a cylindrical inner surface complementary to the outer surface of the rotor, the stator having therethrough a discharge channel. The rotor is at least partially fitted within the recess in the stator with the outer and inner surfaces of the rotor and stator, respectively, being complementarily positioned symmetrically about the axis, such that rotation of the rotor about the axis relative to the stator and/or axial movement of the rotor within the recess relative to the stator selectively bring the flow channel of the rotor into and out of alignment with the discharge channel of the stator.

In accordance with a yet further aspect of the present invention, the rotary valve is mountable within a refractory lining of a bottom wall of a metallurgical vessel and is actuatable for movement from below the bottom wall. The rotary valve includes a refractory rotor rotatable about a substantially vertical axis, the rotor having a cylindrical outer peripheral surface arranged symmetrically about the vertical axis, and the rotor having therethrough a flow channel having inlet and outlet ports opening onto the outer surface. A refractory stator has therein a recess defined by a cylindrical inner surface complementary to the outer surface of the rotor, the stator having therethrough a discharge channel having inlet and outlet ports opening onto the inner surface. The rotor and stator may be in the form of coaxial refractory tubes. The rotor is at least partially fitted within the recess in the stator with the outer and inner surfaces of the rotor and stator, respectively, being complementarily positioned symmetrically about the axis, such that rotation or the rotor about the axis relative to the stator and/or axial movement of the rotor within the recess relative to the stator selectively bring the flow channel of the rotor into and out of alignment with the discharge channel of the stator. The rotary valve is mounted within the refractory lining of the bottom wall of the metallurgical vessel with the rotor extending through the bottom wall and with the rotor actuated for movement from below the bottom wall.

In accordance with yet further aspects of the present invention, there are provided refractory rotors and refractory stators for the above rotary valves.

BRIEF DESCRIPTION OF THE DRAWINGS

Other objects, features and advantages of the present invention will be apparent from the following detailed description of preferred embodiments thereof, wherein.

DETAILED DESCRIPTION OF THE INVENTION

The present application being a continuation-in-part of applicants' copending application Serial No. 227,880, filed Aug. 3, 1988, and entitled "Rotary Valve for a Metallurgical Vessel and Rotor and Stator Therefor", the disclosure of such copending application hereby is incorporated by reference.

Figure 1:
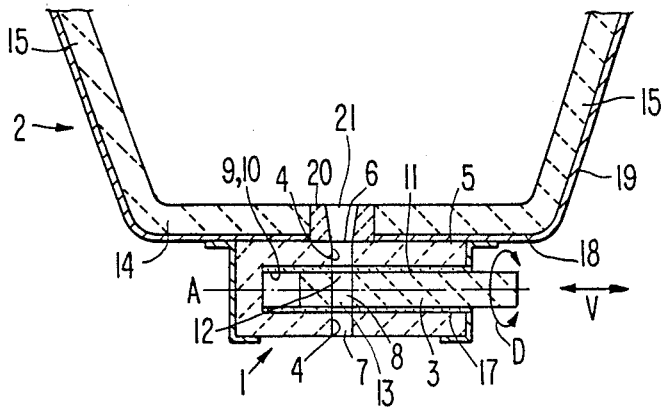
FIGS. 1-5 are somewhat schematic vertical cross-sectional views through the bottoms of metallurgical vessels equipped with rotary valves according to various embodiments of the present invention.

FIG. 1 shows an embodiment of a rotary valve 1 of the present invention mounted on the exterior of a bottom wall 18 of a metallurgical vessel 2. The metallurgical vessel includes side walls 19 having refractory linings 15 and the bottom wall 18 having a refractory lining 14. Within lining 14 is a discharge sleeve 20 having therethrough a conical discharge opening 21. The rotary valve 1 includes a refractory stator 5 having therein a recess 9 defined by a cylindrical inner surface 10. Stator 5 has therethrough a vertical discharge opening 4 aligned with opening 21 and including an inlet port 6 and an outlet port 7. A refractory rotor 3 fits within recess 9 and has a cylindrical outer surface 11 complementary to surface 10 of stator 5. Rotor 3 has therethrough a flow channel 8 including an inlet port 12 and an outlet port 13. The rotary valve is positioned such that outer surface 11 and inner surface 10 are located symmetrically about a substantially horizontal axis A. Rotor 3 is rotatable about axis A within recess 9, as indicated by arrow D. Rotor 3 also is axially movable along axis A within recess 9 as indicated by arrow V. Such rotary and axial movements bring flow channel 8 selectively into and out of alignment with discharge channel 4, thereby controlling the discharge of molten metal from metallurgical vessel 2. FIG. 1 illustrates a further feature of the present invention, that also may be employed in the other embodiments of the present invention. Thus, a sliding or wear sleeve 17 may be inserted between the cylindrical outer surface of rotor 3 and the cylindrical inner surface of stator 5. Sleeve 17 may perform a lubricating function to facilitate rotation and axial movement of the rotor. Different drives may be employed for achieving the rotary movement and the axial movement of the rotor. It may be advantageous to provide that the rotor is formed of a refractory material having a coefficient of heat expansion the same as or less than that of the material of the stator, thereby avoiding stress and possible fracture upon use of the rotary valve at high operating temperatures. In accordance with a further feature of the present invention, one or both of the rotor and the stator may be formed of an oxide ceramic material.

Figure 2:
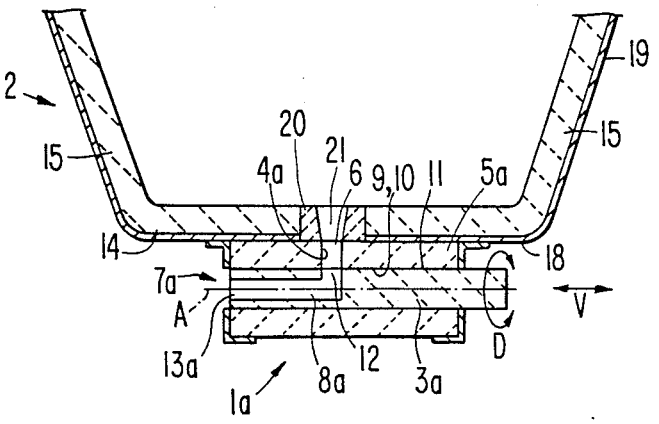

The embodiment of FIG. 2 is similar to the embodiment of FIG. 1. However, whereas in the embodiment of FIG. 1 the outlet ports 13, 7 open onto the respective cylindrical surfaces of the rotor and stator, in the embodiment of FIG. 2 the outlet port 13*a* of flow channel 8*a* opens onto an end surface of the rotor, such end surface extending substantially transverse or perpendicular to axis A, and similarly the outlet port 7*a* of the stator 5*a* opens onto an end surface. Thus, the discharge passage in the embodiment of FIG. 2 includes a first vertical portion and then a second horizontal portion extending parallel to, and preferably coaxially of, axis A.

Figure 3:
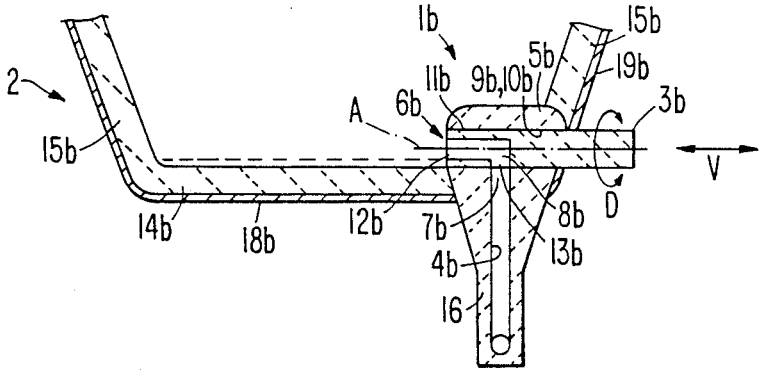

The embodiment of FIG. 3 differs from that of FIGS. 1 and 2 in that rotary valve lb is mountable within at least one of the refractory linings 14*b*, 15*b*. Preferably, the rotary valve may replace portions of such refractory linings. Further preferably, as shown in FIG. 3, the rotary valve 1*b* is located at a transition area between refractory linings 14*b*, 15*b*. Stator 5*b* has therethrough an inner cylindrical surface 10*b* symmetrical about an axis A. Stator 5*b* has therethrough a discharge channel 4*b* having an inlet port 6*b* and an outlet port 7*b*. Surface 10*b* defines a recess 9*b* within which extends a refractory rotor 3*b* having a cylindrical outer surface 11*b*. The rotor has therethrough a flow channel 8*b* including an inlet port 12*b* and an outlet port 13*b*. In this embodiment, the inlet ports 6*b* and 12*b* open onto end surfaces extending substantially transverse or perpendicular to axis A, and the outlet ports 13*b*, 7*b* open onto the respective surfaces 11*b*, 10*b*. Thus, the discharged molten metal first flows through a substantially horizontal path and then flows downwardly through a substantially vertical path. Rotor 3*b* is rotatable about axis A as indicated by arrow D and is axially movable within recess 9*b* as indicated by arrow V. The one-piece stator 5*b* further may include as an integral extension thereof an immersion nozzle 16 having therethrough a duct aligned with discharge port 4*b*.

The above embodiments relate to rotary valves having rotors rotatable about horizontal axes. The embodiment of FIG. 4 however provides a rotary valve including a refractory rotor 3*c* fitted within a refractor stator 5*c* for rotation about a vertical axis A as indicated by arrow D. Rotor 3*c* and stator 5*c* preferably are in the form of coaxially arranged refractory tubes. The rotor 3*c* has therethrough a flow channel 8*c* including at least one inlet port 12*c* (two being shown in FIG. 4) and an outlet port 13*c*. Stator 5*c* has therethrough a discharge channel 4*c* including at least one inlet port 6*c* (two being shown in FIG. 4) and a discharge port 7*c*. Thus, molten metal being discharged flows first horizontally through inlet ports 6*c*, 12*c* and then vertically downwardly through flow channel 8*c*. The rotary valve 1*c* is mounted within refractory lining 14*c* of bottom wall 18*c* of the metallurgical vessel with rotor 3*c* extending through the bottom wall 18*c* and being actuated for movement in both the rotary direction D and the axial direction V from below bottom wall 18*c*. The inlet ports 6*c* are located sufficiently above the bottom of refractory lining 14c that any undesired residues, such as of slag, are retained within the interior of the metallurgical vessel. Guide sleeves or seals 23, for example made of a low friction materal, can be housed between rotor 3c and stator 5c. Also, as illustrated, the lower portion of stator 5c has an internal cross-section that is slightly larger than the outer cross-section of rotor 3c. Thus, rotor 3c is guided only over the upper section or portion of its length within stator 5c. This reduces the frictional resistance between rotor 3c and stator 5c. The tube forming rotor 3c is extended downwardly and may form an immersion tube 16c.

Figure 4:
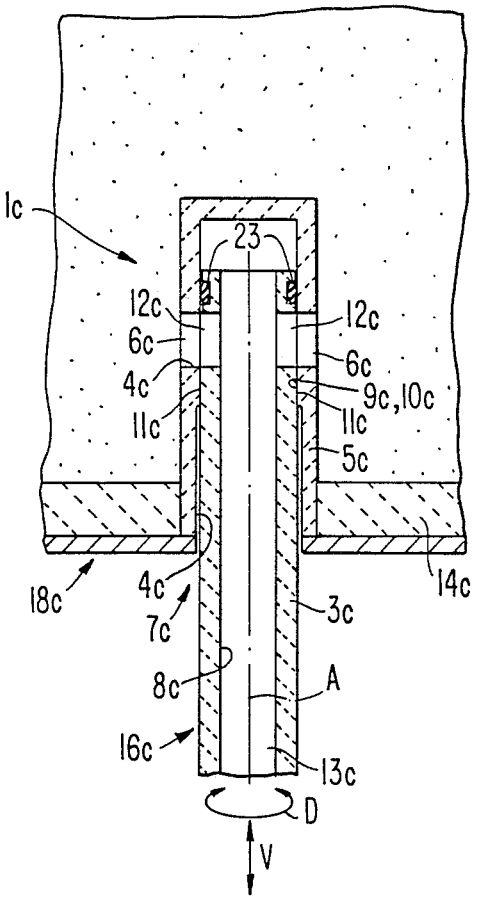
Figure 5:
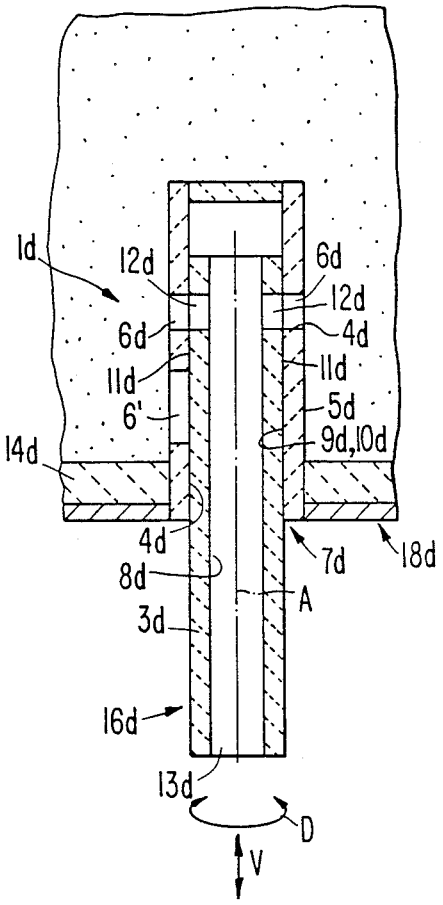

The embodiment of FIG. 5 is similar to the embodiment of FIG. 4. However, in the embodiment of FIG. 5 the stator 5d is provided with at least one additional inlet port or opening 6' located below the inlet ports or openings 6d. In a particularly preferred arrangement, opening 6' has a larger cross-section than openings 6d. Thus, if rotor 3d is moved downwardly axially such that one of the inlet ports or openings 12d is aligned with opening 6', then the discharge and flow channels are opening completely.

By the above embodiments of the present invention, the rotor is well sealed with the stator, or with intervening sleeve 17, without the need for applying a pressure between the sealing surfaces. This is due to the complementary cylindrical configurations of the surfaces of the rotor and stator. Opening or closing of the rotary valves as well as regulation of the amount of opening can be achieved, selectively, by both rotary and/or axial movement of the rotor, as desired. Thus, it is possible to avoid excess wear of particular portions of the rotor and stator by controlling the movements in a particular manner to avoid concentrated stresses and wear at particular areas of the rotary valve. Thereby it is possible to increase the service life of the rotary valve. By the constructions of the various embodiments of the present invention, the rotary portions of the rotary valve are sufficiently heated to avoid undue freezing of the molten metal. The embodiment of FIG. 5 provides the additional advantage that is possible to very rapidly achieve molten metal discharge, for example when necessary to rapidly fill a tundish, whereas during a casting operation the pouring speed may be controlled relatively precisely.

Although the present invention has been described and illustrated with respect to preferred embodiments thereof, it is to be understood that various modifications and changes may be made to the specifically described and illustrated features without departing from the scope of the present invention.

We claim:

1. A rotary valve for controlling the discharge of molten metal in a substantially downward direction from a metallurgical vessel, said valve comprising:

a refractory rotor to be rotatable about an axis to be aligned substantially horizontally, said rotor having a cylindrical outer peripheral surface arranged symmetrically about said axis, and said rotor having therethrough a flow channel having inlet and outlet ports, at least one of said inlet port and said outlet port opening onto said outer surface;

a refractory stator having therein a recess defined by a cylindrical inner surface complementary to said outer surface of said rotor, said stator having therethrough a discharge channel, said stator being mountable on the exterior of the bottom of a metallurgical vessel; and said rotor being mounted to at least partially fit within said recess in said stator with said outer and inner surfaces of said rotor and stator, respectively, being complementarily positioned symmetrically about said axis, such that said rotor is rotatable about said axis relative to said stator and is movable in opposite directions axially relative to said stator, whereby rotation of said rotor about said axis relative to said stator and axial movement of said rotor within said recess relative to said stator selectively bring said flow channel of said rotor into and out of alignment with said discharge channel of said stator.

2. A valve as claimed in claim 1, further comprising means for mounting said stator on the exterior of a metallurgical vessel.

3. A valve as claimed in claim 1, wherein both said inlet port and said outlet port of said flow channel of said open onto said outer surface thereof.

4. A valve as claimed in claim 1, wherein said outlet port of said flow channel of said rotor opens onto an end surface thereof.

5. A valve as claimed in claim 4, wherein said end surface extends substantially transverse to said axis.

6. A valve as claimed in claim 1, wherein said rotor is formed of a material having a coefficient of heat expansion the same as or less than that of the material of said stator.

7. A valve as claimed in claim 1, wherein at least one of said rotor and said stator is formed of an oxide ceramic material.

8. An assembly, including a vessel bottom wall having a refractory lining, at least one vessel side wall having a refractory lining, and said valve of claim 1 mounted on the exterior of said vessel bottom wall.

9. A rotary valve for controlling the discharge of molten metal in a substantially downward direction from a metallurgical vessel, said valve comprising:

a refractory rotor to be rotatable about an axis to be aligned substantially horizontally, said rotor having a cylindrical outer peripheral surface arranged symmetrically about said axis, and said rotor having therethrough a flow channel having inlet and outlet ports, said outlet port opening onto said outer surface;

a one-piece refractory stator having therein a recess defined by a cylindrical inner surface complementary to said outer surface of said rotor, said stator having therethrough a discharge channel; and said rotor being mounted to at least partially fit within said recess in said stator with said outer and inner surfaces of said rotor and stator, respectively, being complementarily positioned symmetrically about said axis, such that said rotor is rotatable about said axis relative to said stator and is movable in opposite directions axially relative to said stator, whereby rotation of said rotor about said axis relative to said stator and axial movement of said rotor within said recess relative to said stator selectively bring said flow channel of said rotor into and out of alignment with said discharge channel of said stator;

said stator with said rotor in said recess therein being mountable within a refractory lining of a side wall or of a bottom wall of a metallurgical vessel.

10. A valve as claimed in claim 9, wherein said inlet port of said rotor opens onto an end surface thereof.

11. A valve as claimed in claim 10, wherein said end surface extends substantially transverse to said axis.

12. A valve as claimed in claim 9, wherein said rotor is formed of a material having a coefficient of heat expansion the same as or less than that of the material of said stator.

13. A valve as claimed in claim 9, wherein at least one of said rotor and said stator is formed of an oxide ceramic material.

14. An assembly, including a vessel bottom wall having a refractory lining, at least one vessel side wall having a refractory lining, and said valve of claim 9 positioned in at least one of said refractory linings at a position to be contacted by molten metal in the vessel.

15. An assembly as claimed in claim 14, wherein said valve is positioned in a transition area between said bottom wall and said side wall.

16. A rotary valve for controlling the discharge of molten metal in a substantially downward direction from a metallurgical vessel, said valve comprising:

a refractory rotor to be rotatable about an axis to be aligned substantially vertically, said rotor having a cylindrical outer peripheral surface arranged symmetrically about said axis, and said rotor having therethrough a flow channel having inlet and outlet ports opening onto said outer surface;

a refractory stator having therein a recess defined by a cylindrical inner surface complementary to said outer surface of said rotor, said stator having therethrough a discharge channel having inlet and outlet ports opening onto said inner surface; and said rotor being mounted to at least partially fit within said recess in said stator with said outer and inner surfaces of said rotor and stator, respectively, being complementarily positioned symmetrically about said axis, such that said rotor is rotatable about said axis relative to said stator and is movable in opposite directions axially relative to said stator, whereby rotation of said rotor about said axis relative to said stator and axial movement of said rotor within said recess relative to said stator selectively bring said flow channel of said rotor into and out of alignment with said discharge channel of said stator;

said stator with said rotor in said recess therein being mountable within a refractory lining of a bottom wall of a metallurgical vessel with said rotor extending through the bottom wall and with said rotor actuatable for movement from below the bottom wall.

17. A valve as claimed in claim 16, further comprising means for rotatably and axially moving said rotor from below the bottom wall.

18. A valve as claimed in claim 16, wherein said rotor is formed of a material having a coefficient of heat expansion the same as or less than that of the material of said stator.

19. A valve as claimed in claim 16, wherein at least one of said rotor and said stator is formed of an oxide ceramic material.

20. A valve as claimed in claim 16, wherein at least one of said rotor and said stator have therethrough a plurality of axially spaced inlet ports.

21. A valve as claimed in claim 20, wherein said axially spaced ports have different sized cross sections.

22. An assembly, including a vessel bottom wall having a refractory lining, at least one vessel side wall having a refractory lining, and said valve of claim 16 positioned in said refractory lining of said bottom wall with said rotor extending through said bottom wall.

23. An assembly as claimed in claim 22, further comprising means for rotatably and axially moving said rotor from below said bottom wall.

24. A valve as claimed in claim 1, wherein a seal is defined between said outer and inner surfaces of said rotor and stator, respectively, at least at areas of said surfaces surrounding said flow channel and said discharge channel, respectively.

25. A valve as claimed in claim 24, wherein said seal is defined by said inner and outer surfaces contacting each other.

26. A valve as claimed in claim 24, wherein said seal is formed by a wear sleeve inserted between said inner and outer surfaces.

27. A valve as claimed in claim 9, wherein a seal is defined between said outer and inner surfaces of said rotor and stator, respectively, at least at areas of said surfaces surrounding said flow channel and said discharge channel, respectively.

28. A valve as claimed in claim 27, wherein said seal is defined by said inner and outer surfaces contacting each other.

29. A valve as claimed in claim 27, wherein said seal is formed by a wear sleeve inserted between said inner and outer surfaces.

30. A valve as claimed in claim 16, wherein a seal is defined between said outer and inner surfaces of said rotor and stator, respectively, at least at areas of said surfaces surrounding said flow channel and said discharge channel, respectively.

31. A valve as claimed in claim 30, wherein said seal is defined by said inner and outer surfaces contacting each other.

32. A valve as claimed in claim 30, wherein said seal is formed by a wear sleeve inserted between said inner and outer surfaces.

* * * * *